US011059639B2

(12) United States Patent
Wochele

(10) Patent No.: US 11,059,639 B2
(45) Date of Patent: Jul. 13, 2021

(54) PROTECTIVE CAP FOR A DISPENSER AND DISPENSER FOR DISCHARGING PHARMACEUTICAL AND/OR COSMETIC LIQUIDS

(71) Applicant: Aptar Radolfzell GmbH, Radolfzell (DE)

(72) Inventor: Matthias Wochele, Rielasingen-Worblingen (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 16/851,516

(22) Filed: Apr. 17, 2020

(65) Prior Publication Data

US 2020/0262622 A1 Aug. 20, 2020

Related U.S. Application Data

(63) Continuation of application No. 15/102,415, filed as application No. PCT/EP2014/075754 on Nov. 27, 2014, now abandoned.

(30) Foreign Application Priority Data

Dec. 17, 2013 (DE) ..... 10 2013 226 253.1

(51) Int. Cl.
*B65D 51/16* (2006.01)
*B65D 47/18* (2006.01)
(Continued)

(52) U.S. Cl.
CPC ..... *B65D 51/1616* (2013.01); *A61J 1/067* (2013.01); *A61J 1/145* (2015.05); *A61J 1/1412* (2013.01);
(Continued)

(58) Field of Classification Search
CPC ..... B65D 51/1616; B65D 47/18; B65D 47/2062; B65D 47/2068; A61J 1/145; A61J 1/067; A61J 1/1412; A45D 34/00
(Continued)

(56) References Cited

U.S. PATENT DOCUMENTS 3,622,049 A 11/1971 Thompson
4,463,880 A 8/1984 Kramer et al.
(Continued)

FOREIGN PATENT DOCUMENTS

CN 1326509 C 7/2007
CN 101296754 A 10/2008
(Continued)

OTHER PUBLICATIONS

International Search Report issued in corresponding International Application No. PCT/EP2014/075754 with English translation, dated Feb. 5, 2015 (7 pages).
(Continued)

*Primary Examiner* — Michael J. Melaragno
(74) *Attorney, Agent, or Firm* — Flynn Thiel, P.C.

(57) ABSTRACT

A protective cap for a dispenser for discharging pharmaceutical and/or cosmetic liquids. The dispenser has a liquid reservoir and a discharge opening through which the liquid can be dispensed into a surrounding atmosphere. The protective cap has at least one ventilation opening for establishing communication between an interior and an outer surrounding area, and a sterile filter which covers the at least one ventilation opening is arranged on the protective cap in order to reduce or prevent an introduction of microbes into the interior of the protective cap via the at least one ventilation opening.

8 Claims, 3 Drawing Sheets

(51) Int. Cl.

| | |
|---|---|
| ***A61J 1/06*** | (2006.01) |
| ***B65D 47/20*** | (2006.01) |
| ***A61J 1/14*** | (2006.01) |
| ***A45D 34/00*** | (2006.01) |

(52) U.S. Cl.
CPC ..... *B65D 47/18* (2013.01); *B65D 47/2062* (2013.01); *B65D 47/2068* (2013.01); *A45D 34/00* (2013.01)

(58) Field of Classification Search
USPC ..... 222/189.09, 189.06
See application file for complete search history.

(56) References Cited

U.S. PATENT DOCUMENTS

| | | | | |
|---|---|---|---|---|
| 4,696,409 | A * | 9/1987 | Vize | B60K 15/0406 137/43 |
| 4,929,354 | A | 5/1990 | Meyering et al. | |
| 4,938,389 | A | 7/1990 | Rossi et al. | |
| 4,957,518 | A * | 9/1990 | Brassell | A61L 11/00 55/385.4 |
| 5,033,647 | A | 7/1991 | Smith et al. | |
| 5,080,800 | A | 1/1992 | Heyl et al. | |
| 5,105,993 | A | 4/1992 | La Haye et al. | |
| 5,154,325 | A | 10/1992 | Ryder et al. | |
| 5,328,063 | A * | 7/1994 | Beck | B65D 47/243 222/524 |
| 5,437,655 | A * | 8/1995 | Bartholomew | B01D 46/0028 141/286 |
| 5,496,471 | A | 3/1996 | Heyl et al. | |
| 5,611,464 | A | 3/1997 | Tsao et al. | |
| 5,849,311 | A | 12/1998 | Sawan et al. | |
| 5,869,073 | A | 2/1999 | Sawan et al. | |
| 5,988,426 | A * | 11/1999 | Stern | B65D 51/1616 215/261 |
| 5,992,701 | A | 11/1999 | Bougamont et al. | |
| 6,000,580 | A | 12/1999 | Nilson | |
| 6,053,368 | A | 4/2000 | Geimer | |
| 6,116,468 | A | 9/2000 | Nilson | |
| 6,126,931 | A | 10/2000 | Sawan et al. | |
| 6,180,584 | B1 | 1/2001 | Sawan et al. | |
| 6,354,469 | B1 * | 3/2002 | Pozzi | B05B 11/0037 222/189.09 |
| 6,708,850 | B2 | 3/2004 | Uetake et al. | |
| 6,904,929 | B2 * | 6/2005 | Ruschke | B67D 3/0029 137/202 |
| 7,011,221 | B2 | 3/2006 | Smith et al. | |
| 7,225,949 | B2 | 6/2007 | Kubo et al. | |
| 7,303,098 | B2 | 12/2007 | Backes | |
| 7,607,548 | B2 * | 10/2009 | Dagn | F01M 11/03 215/293 |
| 7,681,809 | B2 * | 3/2010 | Maget | A61L 9/12 239/326 |
| 7,799,009 | B2 * | 9/2010 | Niedospial, Jr. | A61J 1/2096 604/411 |
| 8,056,766 | B2 | 11/2011 | Grevin | |
| 8,376,165 | B2 | 2/2013 | Chiang | |
| 8,523,020 | B2 * | 9/2013 | Abfall | B65D 83/38 222/192 |
| 8,894,622 | B2 | 11/2014 | Chibret et al. | |
| 9,669,974 | B2 * | 6/2017 | Wochele | B65D 47/265 |
| 9,845,181 | B2 * | 12/2017 | Abraham | B65D 51/1622 |
| 9,908,688 | B2 * | 3/2018 | Abfall | A61L 9/14 |
| 2002/0187176 | A1 | 12/2002 | Yao | |
| 2004/0074925 | A1 | 4/2004 | Faurie | |
| 2004/0129648 | A1 | 7/2004 | Manesis | |
| 2004/0200860 | A1 | 10/2004 | Buxmann | |
| 2005/0173456 | A1 | 8/2005 | Backes | |
| 2006/0011654 | A1 | 1/2006 | Webb | |
| 2006/0180613 | A1 | 8/2006 | Manesis | |
| 2006/0242933 | A1 | 11/2006 | Webb et al. | |
| 2007/0093765 | A1 | 4/2007 | Kawashiro et al. | |
| 2007/0102455 | A1 | 5/2007 | Stark et al. | |
| 2008/0210717 | A1 * | 9/2008 | Dewig | B65D 83/40 222/562 |
| 2008/0302828 | A1 | 12/2008 | Pozzi | |
| 2010/0108712 | A1 | 5/2010 | Manesis | |
| 2010/0147899 | A1 * | 6/2010 | Nardi | B65D 47/18 222/420 |
| 2011/0052900 | A1 | 3/2011 | Uno et al. | |
| 2012/0080449 | A1 * | 4/2012 | Lehmkuhl | B65D 41/0471 222/153.14 |
| 2014/0158712 | A1 * | 6/2014 | Abfall | B65D 83/75 222/131 |
| 2014/0197207 | A1 | 7/2014 | Pozzi | |
| 2014/0336596 | A1 | 11/2014 | Wochele | |
| 2015/0043958 | A1 | 2/2015 | Painchaud et al. | |
| 2015/0166224 | A1 * | 6/2015 | Greiner-Perth | B65D 47/2068 222/153.06 |
| 2015/0166229 | A1 | 6/2015 | Wochele et al. | |
| 2015/0166364 | A1 | 6/2015 | Wiegele | |
| 2015/0352809 | A1 | 12/2015 | Kohlman et al. | |
| 2015/0360156 | A1 | 12/2015 | Swaminathan | |
| 2016/0137390 | A1 | 5/2016 | Wochele | |
| 2016/0311589 | A1 | 10/2016 | Wochele | |
| 2016/0325238 | A1 | 11/2016 | Uchiyama | |
| 2017/0081093 | A1 * | 3/2017 | Fisch | B65D 51/1616 |
| 2017/0081094 | A1 * | 3/2017 | Fisch | B65D 51/1616 |
| 2017/0129662 | A1 * | 5/2017 | Decock | B65D 83/40 |
| 2017/0362000 | A1 * | 12/2017 | Greiner-Perth | B65D 35/46 |

FOREIGN PATENT DOCUMENTS

| | | | |
|---|---|---|---|
| CN | 102079415 | A | 6/2011 |
| DE | 29518284 | U1 | 2/1996 |
| DE | 69324583 | T2 | 9/1999 |
| DE | 10200519 | A1 | 7/2003 |
| DE | 102011086755 | A1 | 5/2013 |
| FR | 2738555 | A1 | 3/1997 |
| GB | 2132989 | A | 7/1984 |
| JP | 55-148067 | U | 10/1980 |
| JP | 2003-290316 | A | 10/2003 |
| JP | 2004166978 | A | 6/2004 |
| WO | 92/12065 | A1 | 7/1992 |
| WO | 2004/089805 | A2 | 10/2004 |
| WO | 2010/004735 | A1 | 1/2010 |
| WO | 2013/140069 | A1 | 9/2013 |

OTHER PUBLICATIONS

Written Opinion of International Searching Authority issued in corresponding International Application No. PCT/EP2014/075754, dated Feb. 5, 2015 (5 pages).

Office Action of Chinese Patent Office issued in corresponding China Application No. 201480067574.9 with English translation, dated Jan. 24, 2018 (12 pages).

Chinese Search Report issued in corresponding China Application No. 201480067574.9 dated Jan. 24, 2018 (3 pages).

Translation of Japanese Office Action issued in corresponding Japan Application No. 2016-535220 dated Apr. 17, 2018 (5 pages).

Opposition proceedings of European Patent Office issued in corresponding European Patent No. 3082707 dated Oct. 17, 2019 (19 pages).

* cited by examiner

PROTECTIVE CAP FOR A DISPENSER AND DISPENSER FOR DISCHARGING PHARMACEUTICAL AND/OR COSMETIC LIQUIDS

CROSS REFERENCE TO RELATED APPLICATIONS

This is a continuation of prior U.S. application Ser. No. 15/102,415, filed Jun. 7, 2016, which was the National Stage of International Application No. PCT/EP2014/075754, filed Nov. 27, 2014, which claims priority to Germany Application No. 10 2013 226 253.1, all of which are hereby incorporated by reference in their entireties.

APPLICATION AREA AND PRIOR ART

The invention relates to a protective cap for a dispenser and to a dispenser for discharging pharmaceutical and/or cosmetic liquids. Such a dispenser comprises a liquid reservoir and an exit opening, through which the liquid can be discharged into a surrounding atmosphere.

A liquid stored in the liquid reservoir is fed in the direction of the exit opening in order to be discharged, it being possible for this to take place by way of a large number of different mechanisms. For example, the liquid reservoir may be designed in the form of a squeeze bottle, of which the contents can be subjected to pressure as a result of the walls being deformed. It is also possible to use a separate pumping device.

Dispensers of the type in question are known from the prior art, for example from DE 10 2011 086 755 A1. The dispenser comprises an outlet channel, which connects the liquid reservoir to the exit opening, and an outlet valve, which is arranged in the outlet channel and opens in a pressure-dependent manner or is manually actuable, wherein the outlet valve, in the closed state, closes the outlet channel. The outlet valve subdivides the outlet channel here into a first part and a second part, wherein the second part, adjacent to the exit opening, extends in the direction of the liquid reservoir. In other configurations, the second part corresponds to a droplet-forming surface at the exit opening.

As a result of the outlet valve, it is always the case that, following closure of the same, it is not possible for any liquid which has passed into a portion of the outlet channel on an outlet-valve side directed away from the liquid reservoir, or which has remained in the surroundings of the exit opening outside the outlet channel, to be sucked back into the dispenser. This therefore prevents the contents of the liquid reservoir from possibly being contaminated by liquid residues which have been sucked back. The residual liquid therefore remains in a region which is accessible from the outside. Upon contact with the atmosphere, the residual liquid dries up quickly.

In order also to make it possible for the residual liquid to dry up quickly when a protective cap is placed in position on the dispenser, DE 10 2011 086 755 A1 discloses providing the protective cap of the dispenser with ventilation openings which create a permanent connection between the region in which residual liquid can remain and exterior surroundings. However, it is possible for the ventilation openings, for their part, to cause contamination again.

In order to avoid contamination, DE 10 2011 086 755 A1 makes provision for surfaces of the outlet channel downstream of the outlet valve, as seen in the discharging direction, and/or an outer surface of a housing which surrounds the exit opening to be of antibacterial design, wherein the antibacterial design is restricted exclusively to these surfaces.

Problem and Solution

It is a problem of the invention to make available a protective cap which is intended for a dispenser, allows rapid drying and in the case of which the problem of microorganisms penetrating into the protective cap is alleviated. A further problem of the invention is that of making available a dispenser with a corresponding protective cap.

A first aspect of the invention provides for a protective cap for a dispenser for discharging pharmaceutical and/or cosmetic liquids, wherein the dispenser has a liquid reservoir and an exit opening, through which the liquid can be discharged into a surrounding atmosphere, and wherein the protective cap has at least one ventilation opening in order for an interior to communicate with exterior surroundings, and the protective cap has arranged on it a sterile filter, which covers the at least one ventilation opening so as to reduce, or to prevent, the introduction of germs into the interior of the protective cap via the at least one ventilation opening.

A second aspect of the invention provides for a discharging device comprising a dispenser for discharging pharmaceutical and/or cosmetic liquids, having a liquid reservoir and having an exit opening, through which the liquid can be discharged into a surrounding atmosphere, and having a protective cap, which has at least one ventilation opening in order for an interior to communicate with exterior surroundings, wherein the protective cap has arranged on it a sterile filter, which covers the at least one ventilation opening so as to reduce, or to prevent, the introduction of germs into the interior of the protective cap via the at least one ventilation opening.

The sterile filter prevents, or at least reduces, the introduction of germs into an interior of the protective cap via the at least one ventilation opening. Germs or microorganisms within the context of the present invention are to be understood as being all microbial pathogens, in particular bacteria and viruses.

The dispenser is suitable, in particular, for unpreserved ophthalmic preparations. In advantageous configurations, the dispenser comprises an outlet channel, which connects the liquid reservoir to the exit opening, and an outlet valve, which opens in a pressure-dependent manner or is manually actuable, is arranged in the outlet channel and, in a closed state, closes the outlet channel. The outlet valve here prevents germs from penetrating into the liquid reservoir. The outlet valve is preferably an outlet valve which opens in a pressure-dependent manner and is opened by the liquid in the liquid reservoir, or an amount removed therefrom, being subjected to pressure and closes automatically again as soon as the corresponding positive pressure in relation to the surroundings is no longer present. It is also possible in principle here, however, to use other types of valve. Provision may thus be made, for example, for the liquid in the liquid reservoir to be subjected permanently to pressure and for the dispenser to be handled by way of a handle which is actuated manually to open the outlet valve. The outlet valve prevents discharged liquid from being sucked back into the liquid reservoir. The at least one ventilation opening causes said residual liquid to dry up rapidly.

The sterile filter preferably has an average pore diameter or a cutoff of at most approximately 0.1 μm to approximately 0.3 μm, preferably at most approximately 0.2 μm. The cutoff describes the size from which particles are held back by the sterile filter. The sterile filter is preferably configured in the form of a membrane filter. A membrane filter with a cutoff between approximately 0.1 μm to approximately 0.3 μm is also referred to as a microfiltration membrane. Bacteria have a size of approximately 0.2 to approximately 5 μm, and can be filtered out efficiently by means of a microfiltration membrane. Depending on the application, it is also possible for the sterile filter to be subjected to more stringent requirements. In particular one configuration provides sterile filters having an average pore diameter or a cutoff of approximately 10 nm. Such membrane filters are also referred to as ultrafiltration membranes. Viruses of a size of 15 nm can also be filtered out using an ultrafiltration membrane.

In one configuration, the sterile filter is produced in the form of a woven fabric made of a polymer or of an inorganic material, for example a ceramic material. In advantageous configurations, the sterile filter is designed in the form of a microporous polymer membrane made of a membrane polymer from the group comprising polysulfone, polyethersulfone, cellulose, cellulose derivatives, polyvinylidene fluoride, polyamide, polyester and polyacrylonitrile and/or combinations thereof.

The sterile filter preferably also serves as an absorber surface, wherein liquid is transported away from the exit opening via the sterile filter and the sterile filter thus advantageously assists rapid drying of the dispenser. For this purpose, the sterile filter is configured in the form of a hydrophilic polymer membrane. Designing the protective cap with an absorber surface which is in contact with the exit opening is also advantageous in configurations which do not have a sterile filter. One configuration provides two membranes functioning as a sterile filter and/or absorber surface. In yet further configurations, a multilayered membrane is provided in the protective cap, wherein a first layer, which is directed toward the exit opening of the dispenser, has absorbent properties and a second layer, which is directed toward the ventilation opening, has filter properties.

In one configuration, the sterile filter is configured in the form of an insert part, which is connected to the protective cap by overmolding. In other configurations, the sterile filter is latched to a wall of the protective cap.

In advantageous configurations, provision is made for the protective cap to comprise a cylindrical portion and a cover portion connected thereto, wherein the at least one ventilation opening is provided on the cover portion. In one configuration, an inner wall of the cylindrical portion has provided on it radially inwardly oriented latching protrusions or an encircling latching protrusion, by means of which the sterile filter is accommodated. In advantageous configurations, latching arms, which project from an inner side of the cover portion, are provided for fastening the sterile filter. Such latching arms allow reliable, correct assembly.

In advantageous configurations, the sterile filter is made of a material which has a sufficient level of mechanical strength for it to be possible for the sterile filter to be latched into the latching arms or latching protrusions. In other configurations, the sterile filter is applied to a carrier layer. The carrier layer here, in one configuration, has material properties which differ from those of the sterile filter. A gas-permeable, hydrophilic carrier layer is preferably provided, and therefore the carrier layer likewise assists drying of the dispenser. The carrier layer and the sterile filter are preferably firmly, in particular integrally, connected to one another, for example by adhesive bonding or welding. In one configuration, the sterile filter is applied to the carrier layer by vapor deposition or sputtering.

The sterile filter is preferably arranged such that, during use, it is in contact with an exit opening of the dispenser, wherein in particular the protective cap has a stop, which forces the sterile filter into contact with the exit opening during use. This means that the sterile filter can be advantageously utilized as an absorber.

BRIEF DESCRIPTION OF THE DRAWINGS

Further advantages and aspects of the invention can be gathered not just from the claims, but also from the following description of preferred exemplary embodiments of the invention, which will be explained hereinbelow with reference to the figures. The drawings use like reference signs to denote the same or similar components. Features illustrated or described as part of an exemplary embodiment can likewise be used in a different exemplary embodiment in order to achieve a further embodiment of the invention. In the drawings:

DETAILED DESCRIPTION OF THE EXEMPLARY EMBODIMENTS

Figure 1:
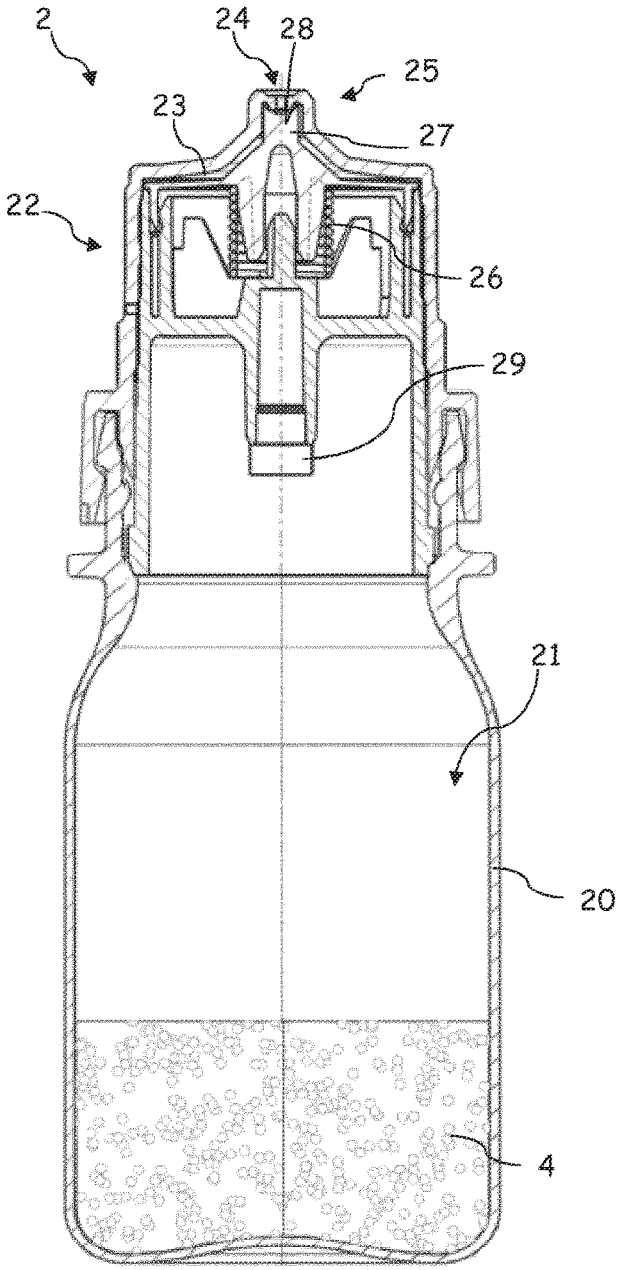
FIG. 1 shows a sectional illustration of a dispenser for discharging pharmaceutical and/or cosmetic liquids.

FIG. 1 shows, in the first instance, a dispenser 2 which is intended for discharging pharmaceutical and/or cosmetic liquids and is suitable, in particular, for unpreserved ophthalmic preparations.

Said dispenser 2 has a liquid reservoir 21, which is delimited by a container body 20. The liquid 4 is stored in the liquid reservoir 21. An outlet subassembly 22 has been placed in position, and fastened by means of a latching connection, on the container body 20. Said outlet subassembly 22 serves for directing liquid from the liquid reservoir 21 to an exit opening 24 through an outlet channel 23. The exit opening 24 illustrated is configured in the form of a droplet-forming surface and widens conically in the discharging direction.

On account of the section plane in FIG. 1, the latter illustrates merely a final part of the outlet channel 23. The outlet channel 23 has arranged in it an outlet valve 25 which, in a closed state, closes the outlet channel 23, and therefore liquid located downstream of the outlet valve 25, as seen in the discharging direction, cannot pass back into the liquid reservoir 21. The outlet valve 25 illustrated comprises a valve body 27, which can be adjusted counter to the force of a restoring spring 26 and interacts with a valve seat 28 formed on a housing wall. Air flows into the liquid reservoir 21, for pressure-equalization purposes, via a filter element 29. In advantageous configurations, the filter element 29 comprises a liquid filter, which is oriented in the direction of the liquid reservoir 21, and a bacteria filter, which is oriented away from the liquid reservoir 21 and has a cutoff of approximately 0.2 μm, so that bacteria of a size of approximately 0.2 to approximately 5 μm are reliably held back by the bacteria filter.

The dispenser 2 illustrated is configured in the form of a so-called squeeze bottle. Said dispenser 2 is used by being placed upside down with the exit opening 24 oriented downward. Thereafter, walls of the container body 20 are pressed together in order for the liquid 4 in the liquid reservoir 21 to be subjected to pressure. This pressure causes the outlet valve 25 to open. More specifically, as soon as the liquid pressure in a part of the outlet channel 23 upstream of the outlet valve 25 is sufficiently high, the valve body 27 shifts counter to the force of the restoring spring 26 as a result of said pressure and frees the path for the liquid in the direction of the exit opening 24.

Following a discharging operation, the outlet valve 25 is closed again. It is usual here for a residue of the liquid, the so-called residual droplet, to remain at the exit opening 24, configured in the form of the droplet-forming surface, and in a part of the outlet channel 23 assigned to the exit opening 24 and located downstream of the outlet valve 25 as seen in the discharging direction. The outlet valve 25, which opens in a pressure-dependent manner, precludes any possibility of the liquid flowing back into the liquid reservoir 12.

Without a protective cap being placed in position, the residual droplet can dry up rapidly. In order to make it possible for rapid drying also to take place when the protective cap has been placed in position, protective caps of the type in question have at least one ventilation opening.

Figure 2:
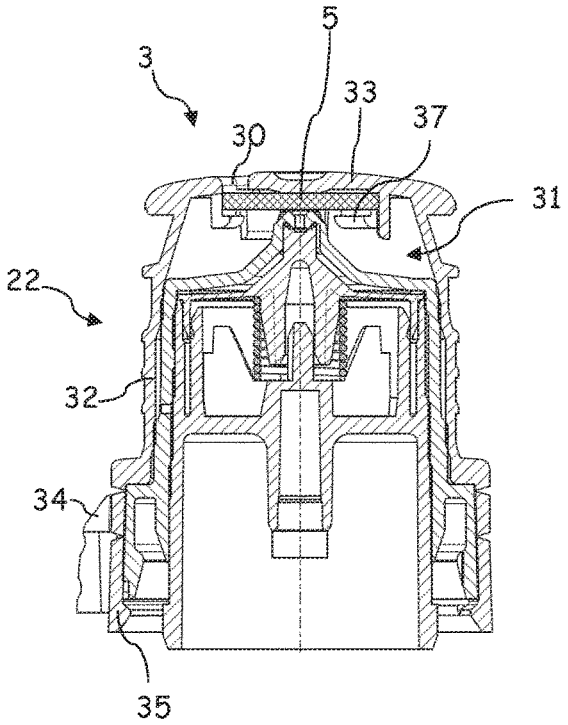
FIG. 2 shows the outlet subassembly according to FIG. 1 with a protective cap according to a first exemplary embodiment.

FIG. 2 shows the outlet subassembly 22 with a protective cap 3 placed in position thereon. The protective cap 3 illustrated has a plurality of ventilation openings 30 in order for an interior 31 to communicate with exterior surroundings. The protective cap 3 comprises an essentially cylindrical portion 32 and a cover portion 33 connected thereto. In the case of the protective cap 3 according to FIG. 2, the ventilation openings 30 are provided on the cover portion 33. The number of ventilation openings 30 can be selected appropriately by a person skilled in the art. In the embodiment according to FIG. 2, the protective cap 3 has three uniformly distributed ventilation openings 30, of which only one can be seen in FIG. 1. The protective cap 3 is produced in the form of an injection molding and has a tamperproof seal 34, which has to be removed when the dispenser is used for the first time. Latching elements 35 for latching to the dispenser 2 according to FIG. 1 are provided on an inner wall. The latching elements 35 here are configured such that they prevent the protective cap 3 from being removed, and/or the outlet subassembly 22 from being pulled off, from the container body 20 without the tamperproof seal 34 being removed. The protective cap 3, in addition, is configured such that it is possible for the protective cap 3 to be repeatedly removed from the dispenser 2 and be placed in position with clamping action thereon. For this purpose, the protective cap 3 is deformed to a slight extent when being placed in position, and therefore the elastic restoring forces of a protective cap 3 produced from plastics material generate a clamping action. In other configurations, latching elements are provided for this purpose.

According to the application, the protective cap 3 has a sterile filter 5, which covers the ventilation openings 30 and prevents, or at least reduces, the introduction of germs into an interior 31 of the protective cap 3 via the ventilation openings 30. The sterile filter 5 has a cutoff of at most 0.2 μm, and therefore bacteria of a size of approximately 0.2 to approximately 5 μm are reliably held back.

In the exemplary embodiment illustrated, the sterile filter 5 is arranged parallel to the cover portion 33 of the protective cap 3, on an inner side of the cover portion 33, and covering the ventilation openings 30. For fastening the sterile filter 5, in the exemplary embodiment illustrated, latching arms 37 are provided on the protective cap 3, on the inner side of the cover portion 33. The latching arms 37 project from the cover portion 33 in the longitudinal direction of the protective cap 3. For the purpose of fitting the sterile filter 5, the latching arms 37 are deformed elastically.

As can be seen in FIG. 2, when the protective cap 3 has been placed in position, the sterile filter 5 is in contact with a point at the top of the dispenser 2, assigned to the exit opening 24. A material of the sterile filter 5 is selected here such that the sterile filter 5 can also be utilized as an absorber surface for rapid distribution of the residual droplet remaining in the region of the exit opening 24, and thus for rapid drying. In one configuration, the sterile filter 5, for this purpose, is designed in the form of a hydrophilic polymer membrane made of a membrane polymer from the group comprising polysulfone, polyethersulfone, cellulose, cellulose derivatives, polyvinylidene fluoride, polyamide, polyester and polyacrylonitrile and/or combinations thereof. The sterile filter 5 illustrated is made of a material which has a sufficient level of strength for it to be possible for the sterile filter 5 to be latched into the latching arms 37.

Figure 3:
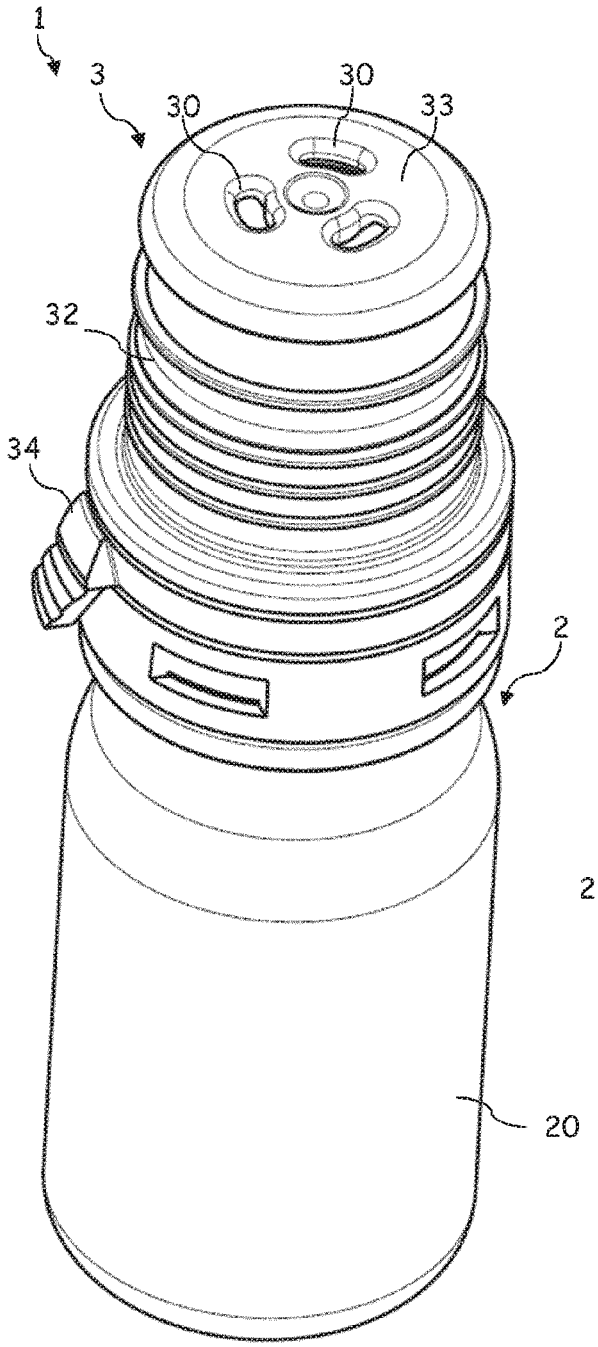
FIG. 3 shows an overall perspective illustration of a discharging device comprising a dispenser and a protective cap.
Figure 4:
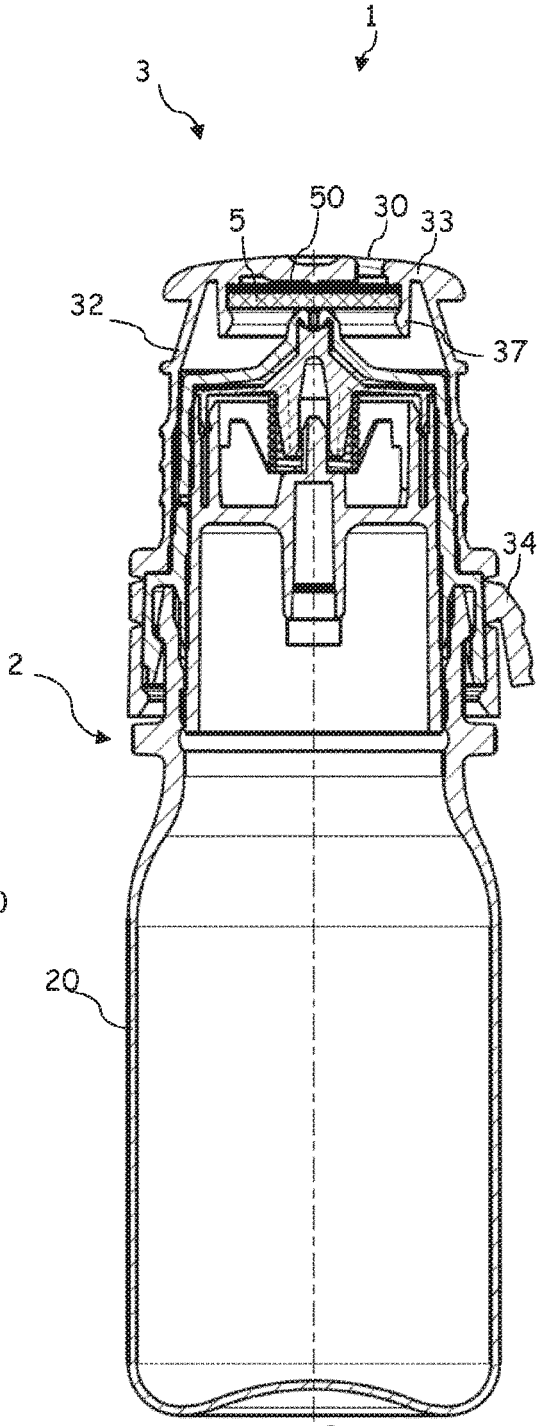
FIG. 4 shows a sectional illustration of the discharging device according to FIG. 3.

FIGS. 3 and 4 show a discharging device 1 comprising a dispenser 2 according to FIG. 1 and a protective cap 3 similar to FIG. 2 in an overall perspective illustration and a sectional illustration, respectively. For a description of the dispenser 2, you are referred to the text above. The protective cap 3 according to FIGS. 3 and 4 likewise corresponds essentially to the protective cap 3 according to FIG. 2, and like reference signs are used for the same or similar components.

In contrast to the embodiment according to FIG. 2, the sterile filter 5 according to FIGS. 3 and 4 is fitted on a carrier layer 50. A material of the carrier layer 50 is selected such that the carrier layer 50 imparts a higher level of mechanical strength to the sterile filter 5 connected to it. In advantageous configurations, the carrier layer 50 is likewise produced from a hydrophilic material, so as to ensure sufficient discharge of moisture to the surroundings via the carrier layer 50. In the exemplary embodiment illustrated, the carrier layer 50 is arranged on an outer side of the sterile filter 5, said outer side being directed toward the surroundings. In other configurations, the carrier layer 50 is arranged on an inner side of the sterile filter 5, said inner side being directed toward the interior 31 of the protective cap 3.

Figure 5:
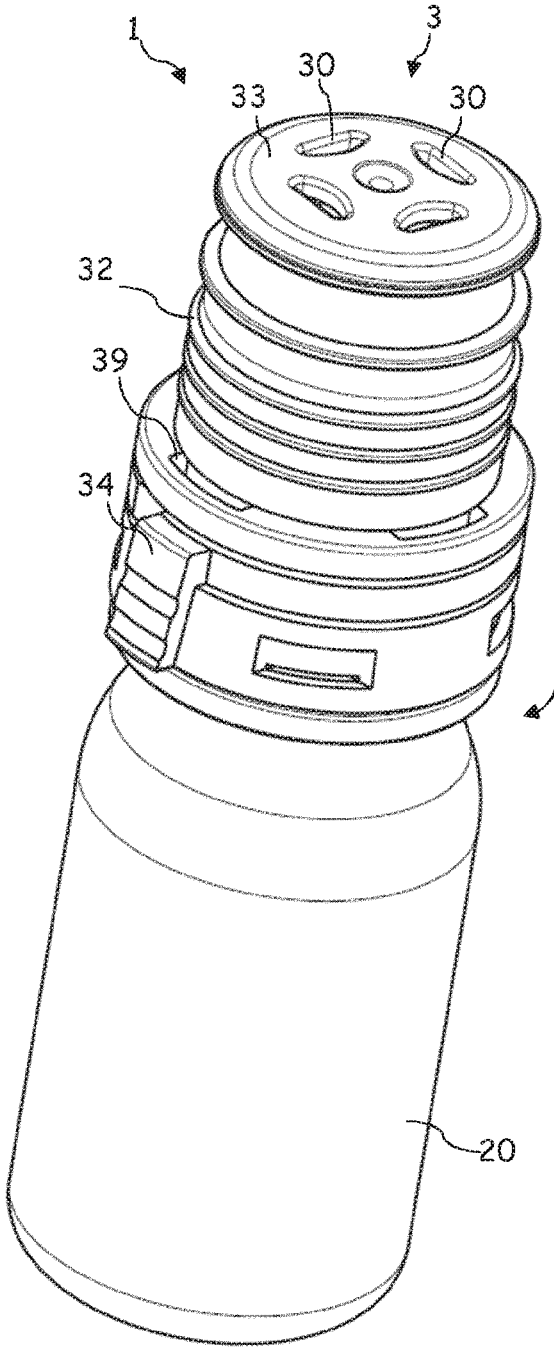
FIG. 5 shows an overall perspective illustration of an alternative configuration of a discharging device comprising a dispenser and a protective cap.
Figure 6:
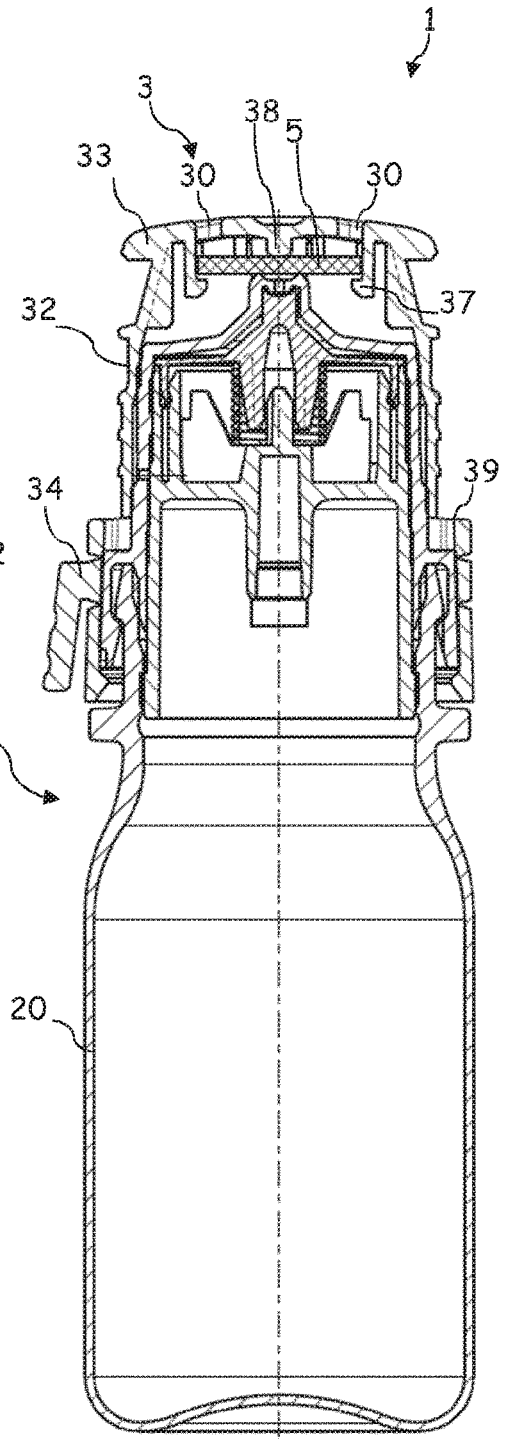
FIG. 6 shows a sectional illustration of the discharging device according to FIG. 5.

FIGS. 5 and 6 show a discharging device 1 comprising a dispenser 2 according to FIG. 1 and a further configuration of a protective cap 3 similar to FIG. 2 in an overall perspective illustration and a sectional illustration, respectively. For a description of the dispenser 2, you are referred to the text above. The protective cap 3 according to FIGS. 5 and 6 likewise corresponds essentially to the protective cap 3 according to FIG. 2, and like reference signs are used for the same or similar components.

In contrast to the embodiment according to FIG. 2, the protective cap 3 has four ventilation openings 30.

As described above, advantageous configurations make provision, when the protective cap 3 has been placed in position, for the sterile filter 5 to be in contact with a point at the top of the dispenser 2, assigned to the exit opening 24. In order to force the sterile filter 5 into contact with the point at the top of the dispenser, the protective cap 3 according to FIGS. 5 and 6 has a stop 38, which projects from the inner side of the cover portion 33. Fastening the sterile filter 5 by means of the latching arms 37 and the stop 38 maximizes a free surface area of the sterile filter 5. This optimizes an absorber effect and drying of the dispenser by means of the sterile filter 5.

In order to reduce the introduction of germs, and thus the loading to which the membrane is subjected, during relatively long-term storage, during storage in surroundings containing lots of germs and/or prior to the dispenser being used for the first time, provision is made, in one configuration, for an additional cover cap (not illustrated), to be fitted over the protective cap 3. For fastening of said cover cap (not illustrated), the protective cap 3 according to FIGS. 5 and 6 has accommodating openings 39.

The invention claimed is:

1. A discharging device comprising:

a dispenser for discharging pharmaceutical and/or cosmetic liquids, the dispenser having a liquid reservoir and an exit opening through which the liquid can be discharged into a surrounding atmosphere; and a protective cap having at least one ventilation opening in order for an interior to communicate with exterior surroundings, wherein the protective cap has arranged thereon a sterile filter which covers the at least one ventilation opening so as to reduce, or to prevent, introduction of germs into the interior of the protective cap via the at least one ventilation opening;

wherein the sterile filter is designed in the form of a microporous polymer membrane, made of a membrane polymer from the group comprising polysulfone, polyethersulfone, cellulose, cellulose derivatives, polyvinylidene fluoride, polyamide, polyester and polyacrylonitrile and/or combinations thereof; and wherein the sterile filter is applied to a carrier layer functioning as absorber surface, the carrier layer being arranged such that, during use, the carrier layer is in contact with the exit opening of the dispenser.

2. The discharging device as claimed in claim 1, wherein the sterile filter has an average pore diameter or a cutoff of at most approximately 0.1 μm to approximately 0.3 μm.

3. The discharging device as claimed in claim 1, wherein the sterile filter has an average pore diameter or a cutoff of at most approximately 0.2 μm.

4. The discharging device as claimed in claim 1, wherein the sterile filter is latched to a wall of the protective cap.

5. The discharging device as claimed in claim 1, wherein the protective cap comprises a cylindrical portion and a cover portion connected thereto, wherein the at least one ventilation opening is provided on the cover portion.

6. The discharging device as claimed in claim 5, wherein latching arms, which project from an inner side of the cover portion, are provided for fastening the sterile filter.

7. The discharging device as claimed in claim 1, wherein the carrier layer is provided as a gas-permeable, hydrophilic carrier layer.

8. The discharging device as claimed in claim 1, wherein the dispenser has an outlet channel which connects the liquid reservoir to the exit opening and an outlet valve which opens in a pressure-dependent manner or is manually actuable, is arranged in the outlet channel and, in a closed state, closes the outlet channel.

* * * * *